United States Patent [19]

Squibbs

[11] 4,242,532

[45] Dec. 30, 1980

[54] METHOD OF CONTROLLING EXHAUST GAS EMISSIONS FROM AN ELECTRIC ARC FURNACE

[75] Inventor: John D. Squibbs, Dearborn, Mich.

[73] Assignee: Ford Motor Company, Dearborn, Mich.

[21] Appl. No.: 106,204

[22] Filed: Dec. 21, 1979

[51] Int. Cl.[3] ..... H05B 7/144; F27D 17/00

[52] U.S. Cl. ..... 13/34; 13/13

[58] Field of Search ..... 13/1, 9, 9 ES, 13, 34

[56] References Cited

U.S. PATENT DOCUMENTS

| | | | |
|---|---|---|---|
| 2,684,392 | 7/1954 | Moore | 13/34 X |
| 3,533,611 | 10/1970 | Boyer et al. | 13/9 R X |
| 3,565,407 | 2/1971 | Schermer | 13/1 X |
| 4,099,019 | 7/1978 | Horibe et al. | 13/9 R |

*Primary Examiner*—Roy N. Envall, Jr.

*Attorney, Agent, or Firm*—Joseph W. Malleck; Olin B. Johnson

[57] ABSTRACT

A method for controlling exhaust gases emitted from a direct arc furnace melting furnace. Prior to cleaning the temperature of the gases is sensed and the arc power is regulated in response to the sensed exhaust gas temperature. Also, the cleaning process of the gases is changed depending upon the sensed gas temperature.

8 Claims, 1 Drawing Figure

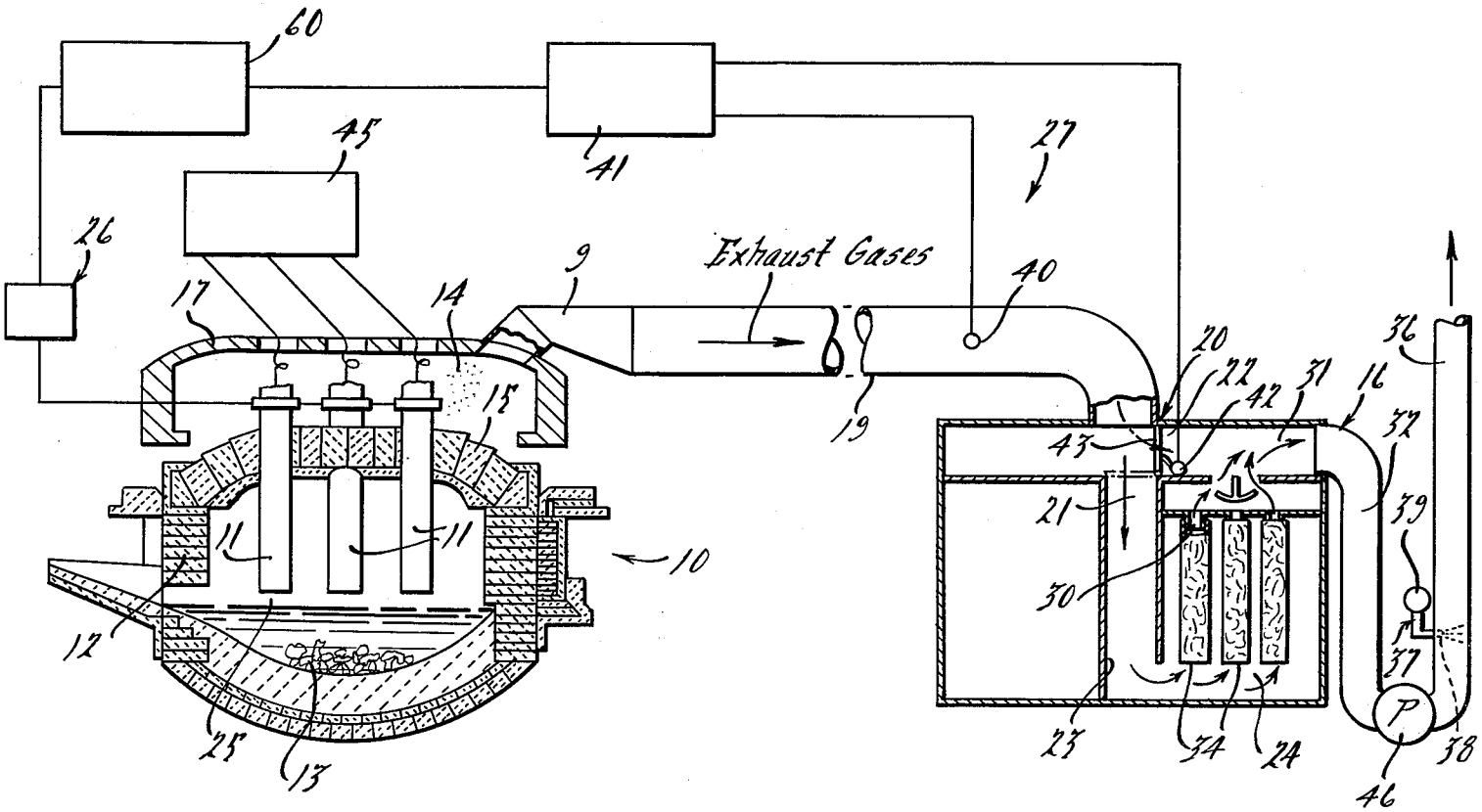
Exhaust Gases

METHOD OF CONTROLLING EXHAUST GAS EMISSIONS FROM AN ELECTRIC ARC FURNACE

BACKGROUND OF THE INVENTION

The direct arc electric furnace is the type most commonly used today in the production of low sulfur, low inclusion iron which is particularly useful in the casting industry. It is primarily a scrap melting furnace made possible by the use of extremely high amperage exceeding 100,000 amps. Cylindrical, solid graphite electrodes are suspended above the furnace shell and extend down through ports in the furnace roof and exhaust hood. The electrodes are used to conduct the electric current which passes from one electrode through an arc to the metal charge, through the metal charge, and thence out through an arc to another electrode.

The electrodes are positioned at various distances from the solid or molten metal to be heated, depending on the stage of heating during an electric arc furnace run. For example, during the initial cold melting stage of solid scrap metal, the electrodes are typically brought closer than three inches to the charge and may be contacting some of the scrap. The power and current passing through the electrodes is at least twice that which is used during the hot refining stage of the entire heating sequence. The electrodes essentially burn a hole through the scrap with electrodes being lowered closer to the bottom of the furnace where a molten pool is forming. Continued melting takes place by solid metal falling into the holes as they widen, adding to the pool.

This tremendous surge of power and close proximity of the electrodes to the metal charge creates a violent electrical discharge in this early stage of the heating sequence. Considerable generation of gas takes place, along with a large amount of metal dust. The furnace gas that is emitted is characteristically dry, with a very high electrical resistivity. Therefore, with the large amount of fume generation and dust, a cleansing station is necessary to process the fumes and gather the dust before releasing the gases to the atmosphere.

Various means have been used for collection, including hoods mounted directly on the furnace, hoods mounted separately over the top of the furnace, offtake pipes that apply suction to the furnace directly through an opening in the roof or sidewall of the furnace, a variation of the direct offtake called a "snorkle" that collects fumes by stack effect through an opening in the furnace roof, and even evacuation of the entire building in which the furnace is housed.

The use of the roof as a hood over the top of the furnace appears to offer the best functional advantage, from the standpoint of efficiency of collection, and minimal effects on metallurgical conditions. Such a roof evacuation system delivers the collected gases to a bag house consisting of a plenum and a number of filtering bags or compartments. Since the exhaust gas is laden with particles widely varying in size from sibmicron mean particle size to very large particle sizes, the cloth type filter or bag appears to be the most efficient, economical means of cleansing the gas. It has become typical for such bags to be constructed of polyester synthetic woven cloths for the filter medium. However, such filtering bags have a temperature limitation of typically 300° F. If such temperature is exceeded, the effectiveness of the bags may be destroyed by a weakening of the cloth and eventual holes.

To protect the bag filters from temperatures in excess of about 300° F., it is typical to employ a thermal sensing device to open a bypass damper or gate upon sensing the excess temperature of 300° F. or more. When the treatment station is bypassed, the fumes from the electric arc furnace will be either sent to the atmosphere or to other treatment or holding zones.

The bypass, being independent of flow, often exaggerates the volume of the bypassed gases. This may result from high energy particles in the form of sparking slag particles which bombard the thermocouple. These momentary thermal pulses can occur quite frequently in a given time span, much quicker than the response cycle of the bypass system employing a mechanical actuator. As a result, the bypass system tends to stay open for a considerable period of time which greatly reduces the effectiveness of the filtering system, particularly during the cold melting stage of the furnace run.

SUMMARY OF THE INVENTION

The invention is concerned with a method for controlling exhaust gases emitted from a direct arc melting furnace. For purposes of carrying out the method, the furnace is equipped with an electrode suspension system for raising and lowering the furnace electrodes in relation to metal within the furnace, thereby regulating the arc gap between the electrodes and metal. The furnace also has a conventional exhaust gas conditioning system which is effective to collect gases generated by the furnace operation and deliver such gases to a treatment station. In the treatment station, the exhaust gases are filtered to eliminate particulate matter and washed to remove odors so that the treated gases will be in a condition for release to the atmosphere substantially devoid of pollutants.

In the method of this invention, the temperature of the exhaust gases is continuously sensed at a sensing location positioned in the exhaust gas conditioning system upstream from the entrance to the treating station, i.e., between the furnace and the treating station. Advantageously, this sensing location is in close proximity to the treating station. Positioned at this sensing location are temperature sensing means effective to continuously sense the temperature of the exhaust gases and to generate a control signal directly proportional to the temperature sensed.

Signal interpretation and measuring means, operatively connected with said sensing means and with first and second actuating means, divide the continuous control signal into three categories. The first actuator means is an override control of the electrode suspension control system and the second actuator means is a control of the bypass means. The first category comprises control signal strength levels below a first actuation level. The second category comprises control signal strength levels at and above said first actuation level, but below a second actuation level. The third category comprises control signal strength levels at or above the second actuation level.

So long as the temperature of the exhaust gases fails to rise to that predetermined temperature at which the sensing means causes the control signal strength to rise to the first actuation level, the exhaust gases in the exhaust gas conditioning system are directed into the treatment station for filtering and scrubbing, and both the first and second actuator means remain inactive.

When the temperature of the exhaust gases reaches the predetermined temperature at which the sensing means causes the control signal strength to rise to the first actuation level, the first actuation means, which is operatively connected with the signal interpretation and measuring means and with the electrode suspension control system, is actuated causing the electrode suspension control system to regulate the current to the metal charge in the furnace. Once the first actuator means is actuated, the electrode suspension control system can be caused to increase the gap continuously or stepwise as the control signal strength rises from the first actuation level toward the second actuation level, and to continuously or stepwise decrease such gap as control signal strength decreases toward said first actuation level.

In another embodiment, the electrode suspension control system, once actuated, moves the electrode to define a predetermined gap and such position is maintained until the strength of the control signal decreases to below the first actuation level, whereupon the electrode suspension control system returns the electrodes to their original position. During the time when the sensed temperature of the exhaust gases is such as to provide a control signal at or above the first actuation level and below the second actuation level, the exhaust gases continue to flow into the treating station.

When the temperature of the exhaust gases reaches the predetermined temperature at which the sensing means causes the control signal strength to rise to the second actuation level, the second actuation means, which is operatively connected with the signal interpretation and measurement means and with bypass means effective for diverting the exhaust gases away from the treatment station, is activated. Once the second means is actuated, the bypass means remains open and diverts the exhaust gases away from the treatment station until the control signal strength recedes below the second actuation level. The diverted gases may be diverted to other treatment or holding zones or vented to the atmosphere.

The temperature chosen to provide a control signal of the first actuation level should be selected to be a measurable number of degrees below the temperature chosen to provide a control signal of the second actuation level. Advantageously, the first actuation level represents a temperature at least 25° F. below the temperature chosen to produce a control signal of the second actuation level. Thus, for example, it may be decided to select 275° F. as the sensed temperature at which a control signal of the first actuation level is generated and 300° F. as the sensed temperature at which a control signal of the second actuation level is generated.

When the exhaust gas temperature falls, the first actuator means causes the electrode suspension control system to decrease the arc gap by returning the electrodes toward their initial position. The response to decrease this arc gap may be designed to provide either immediate or delayed return. Advantageously, complete return is delayed for a short time, e.g., up to 90 seconds or more.

Advantageously, the electrode suspension control system is capable of increasing the arc gap when required to as much as six inches or more within a few seconds, e.g., 2–5, preferably 2–3 seconds, to extinguish the arc.

The electrode suspension system may be advantageously controlled by a closed loop computer programmed to cycle the actuation of the suspension system on a continuous basis and thereby achieve a relatively constant exhaust gas temperature.

Accordingly, a primary object of the invention is to improve the reliability of an exhaust gas conditioning system useful for direct arc electric furnaces so that the system is more continuously in operation according to design parameters, thereby increasing the effectiveness of exhaust cleanup.

SUMMARY OF THE DRAWING

The FIGURE is a schematic illustration of a typical direct arc electric furnace installation and exhaust gas conditioning system showing a service station, including a bag house and a washing zone.

DETAILED DESCRIPTION

The direct arc electric furnace or melting system with which the present inventive method is concerned is illustrated in the FIGURE. The furnace 10 has a plurality of electrical electrodes 11 of sufficient design to melt a metal charge when the electrodes are placed in an arc forming relationship within the interior of the vessel 12. The electrodes receive electrical power and current control from conventional means 45. An arc gap 25 is arranged between the end of the electrode and the metal charge across which the electrical arc discharge takes place. Solid scrap metal is usually added to the vessel for purposes of presenting a metal charge, although some portion of the charge may be molten metal. The metal melting operation comprises essentially two stages, the first of which is considered a cold melting phase whereby the electrodes 11 are brought into a specific close arcing relationship with the solid scrap metal charge 13, with the current and voltage applied at maximum levels, typically three times that of the second phase. The bottom of the electrodes may be actually in contact with the scrap, the arc jumping from the sides of the electrode end or electrode surface not in contact. The metal is subjected to a violent thermal electrical discharge, with the result that a considerable amount of gases are evolved, along with a substantial amount of small dust particles 14 from the metal scrap and electrodes.

The melting is continued by essentially boring a hole (for each electrode) through the scrap metal by heat. The electrodes are lowered almost to the bottom of the vessel where a molten pool of metal is forming. The electrodes are adjusted to stay within 3–6 inches of this molten pool as it rises. Surrounding solid scrap falls into the holes and becomes melted.

An electrode suspension control system 26 is employed to raise and lower the electrodes 11 to adjust the arc gap. A system as described on pages 560–561 of "Making, Shaping and Treating of Steel", by United States Steel Corporation, published by Herbich and Held, 9th Edition, 1971, would be suitable for the method herein and the referenced disclosure is incorporated herein by reference.

An exhaust gas conditioning system 27 is employed to collect and treat the gases. To this end, a movable hood 17 is suspended directly over the roof 15 of the furnace. A water cooled elbow 9 may be directly connected to the hood to extract the gases from the interior of the furnace. The large volume of generated gases is sent directly to a treating station 16 by way of a channel 19 connecting to the elbow 9. The channel used in tests associated with this embodiment has a cross-sectional area of about 23 square feet and a diameter of about 70 inches. The cross-section of the channel is generally uniform throughout its length.

Channel 19 connects with the treating station 16 by way of a bypass union 20 having two outlets 21 and 22. The outlet 21 connects with the down-duct 23 leading to the inlet manifold or plenum 24 of a bag house. At least one bank of filtering compartments 34 or bags in the bag house are connected by way of flow tubes 30 to another channel 31 of generally uniform cross-section, which in turn connects with a down-duct 32 leading to a power exhaust fan 46. The power exhaust fan is employed to drive the flow of gas through said system typically at a velocity of about 4000 cfm. The filtering bags 34 are typically made of a woven polyester material which has a shortened life, should the gas coming into contact therewith be 300° F. or higher in temperature. Sparking particles or high temperature gas cause holes in the fabric, permitting leakage or bypass of the filter.

The treating station may further comprise an upduct 36. A liquid spray system 37 may be associated with the duct, the system 37 having at least one nozzle 38 effective to spray the entire cross-section of the exhaust duct with a solution containing an odor neutralizing chemical. The solution is conveyed through the nozzle at a volume rate determined by a dispensing control station 39.

To improve the reliability and continuity of operation of the exhaust gas conditioning system 27, the method of this invention is employed. The temperature of the exhaust gases is continuously sensed by a sensing means 40 positioned in the exhaust gas conditioning system upstream from the entrance to the treating station 16, preferably in channel 19 between the furnace and treating station as shown in FIG. 1. Advantageously, this sensing location is in close proximity to the treating station. The sensing means 40 comprises a temperature sensing means effective to continuously sense the temperature of the exhaust gases and to generate an electrical control signal directly proportional to the temperature sensed, such as a thermol couple.

Signal interpretation and measuring means 41 is operatively connected with the sensing means 40 and with first and second actuating means (60 and 41, respectively). The first actuator means is an override control of the electrode suspension control system 45; the second actuator means is a control for the bypass damper gate or means 43 to move the gate from a position shown in full line in FIG. 1 to a position shown in broken line where the exhaust gases will enter channel 31 bypassing the filter bags 34.

Means 41 divides the continuous control signal into three categories. The first category comprises control signal strength levels below a first actuation level. The second category comprises control signal strength levels at and above said first actuation level, but below a second actuation level. The third category comprises control signal strength levels at or above the second actuation level.

So long as the temperature of the exhaust gases fails to rise to that predetermined temperature at which the sensing means 40 causes the control signal strength to rise to the first actuation level, the exhaust gases in the exhaust gas conditioning system 27 are directed into the treatment station 16 for filtering and scrubbing while both the first and second actuator means remain inactive.

When the temperature of the exhaust gases reaches the predetermined temperature at which the sensing means 40 causes the control signal strength to rise to the first actuation level, the first actuation means 60 which is operatively connected with the signal interpretation and measuring means 41 and with the electrode suspension control system 45, is actuated, causing the electrode suspension control system 45 to regulate the current to the metal charge 13 in the furnace. Once the first actuator means 60 is actuated, the electrode suspension control system can be caused to increase the gap 25 continuously or stepwise as the control signal strength rises from the first actuation level toward the second actuation level and to continuously or stepwise decrease such gap as control signal strength decreases toward said first actuation level.

During the time when the sensed temperature of the exhaust gases is such as to provide a control signal at or above the first actuation level and below the second actuation level, the exhaust gases continue to flow into the treating station.

When the temperature of the exhaust gases reaches the predetermined temperature at which the sensing means causes the control signal strength to rise to the second actuation level, the second actuation means 42, which is operatively connected with the signal interpretation and measurement means 41 and with bypass means 43, effective for diverting the exhaust gases away from the treatment station, is actuated. Once the second means is actuated, the bypass means remains open and diverts the exhaust gases away from the treatment station until the control signal strength recedes below the second actuation level. The diverted gases may be diverted to other treatment or holding zones or vented to the atmosphere.

The temperature chosen to provide a control signal of the first actuation level should be selected to be a measurable number of degrees below the temperature chosen to provide a control signal of the second actuation level. Advantageously, the first actuation level represents a temperature at least 25° F. below the temperature chosen to produce a control signal of the second actuation level. Thus, for example, it was decided for this embodiment to select 275° F. as the sensed temperature at which a control signal of the first actuation level is generated and 300° F. as the sensed temperature at which a control signal of the second actuation level is generated.

When the exhaust gas temperature falls, the first actuator means 60 causes the electrode suspension control system 27 to decrease the arc gap 25 by returning the electrodes toward their initial position. In response to decrease, this arc gap may be designed to provide either immediate or delayed return. Advantageously, complete return is delayed for a short time, e.g., up to 90 seconds or more.

The electrode suspension control system should preferably be capable of increasing the arc gap when required to as much as six inches or more within a few seconds, e.g., 2–5, preferably 2–3 seconds, to extinguish the arc. The electrode suspension system may be advantageously controlled by a closed loop computer programmed to cycle the actuation, which computer can form part of of the actuator means 60.

The following is a preferred method mode for controlling exhaust gases from a direct arc electric furnace having (a) an electrode suspension control system effective to raise and lower furnace electrodes in relation to a metal charge within the furnace thereby to regulate the arc gap between said electrodes and said metal, (b) an exhaust conditioning system effective to collect gases generated by operation of said furnace and deliver said gases to a treatment station for removal of air pollutants from said gases, and (c) bypass means effective for diverting said gases away from said treatment station when the temperature of said gases exceeds a predetermined temperature, the method comprises:

(1) at a sensing location in said exhaust conditioning system positioned upstream from the entrance to said treating station, continuously sensing the temperature of said gases and generating a control signal having a strength directly proportional to the temperature sensed, (2) dividing said continuous control signal into three categories based on the strength of said continuous control signal, said three categories including (a) a first category comprising strength levels below a first actuation level, (b) a second category comprising strength levels at and above said first actuation level, but below a second actuation level, and (c) a third category comprising strength levels at or above said second actuation level, said second actuation level indicating a measurably higher gas temperature at said sensing location than the gas temperature at said sensing location at said first actuation level, (3) directing said gases in said exhaust conditioning system into said treatment station when said control signal is in said first category or said second category.

(4) actuating said electrode suspension control system to alter the arc gap to regulate the current to said metal when said control signal is in said second category, and (5) actuating said bypass means whereby said gases are diverted away from said treatment station when said control signal is in said third category.

As an alternative method modification, the electrode suspension control system, once actuated by means 60, moves the electrodes to define a predetermined gap. Such new position is maintained until the strength of the control signal decreases to below the first actuation level whereupon the electrode suspension control system returns the electrodes to their original position. In this modification, it would be advantageous to move the electrodes to provide an arc gap of at least six inches to extinguish the arc, and to decrease the arc gap only after about a 90 second interval is experienced after the control signal decreases to below the first actuation level. It is also possible to move the electrodes to provide an arc gap so that the arc is not extinguished, but changed in current carrying capacity. This may be advantageously accomplished by varying the arc gap to be within the range of 2–5 inches and varied within that range to control the current input to the metal charge which in turn reduces the violent melting action and promotes a lower controlled exhaust gas temperature.

It is obvious from the foregoing that the temperature sensing means can be designed to continuously sense the temperature of the exhaust gases and to generate a control signal that is inversely proportional to the temperature sensed. In such an embodiment, the first and second actuation means would be activated as in the previously described embodiments, but with the difference that actuation would occur upon the decrease of the signal to predetermined levels and the three categories of control signal strength levels would be reversed.

I claim:

1. A method for controlling exhaust gases from a direct arc electric furnace having (A) an electrode suspension control system effective to raise and lower furnace electrodes in relation to a metal charge within the furnace thereby to regulate the arc gap between said electrodes and said metal, (B) an exhaust conditioning system effective to collect gases generated by operation of said furnace and deliver said gases to a treatment station for removal of air pollutants from said gases, and (C) bypass means effective for diverting said gases away from said treatment station when the temperature of said gases exceeds a predetermined temperature, said method comprising:

(1) at a sensing location in said exhaust conditioning system positioned upstream from the entrance to said treating station, continuously sensing the temperature of said gases and generating a control signal having a strength directly proportional to the temperature sensed, (2) dividing said continuous control signal into three categories based on the strength of said continuous control signal, said three categories including (a) a first category comprising strength levels below a first actuation level, (b) a second category comprising strength levels at and above said first actuation level, but below a second actuation level, and (c) a third category comprising strength levels at or above said second actuation level, said second actuation level indicating a measurably higher gas temperature at said sensing location than the gas temperature at said sensing location at said first actuation level, (3) directing said gases in said exhaust conditioning system into said treatment station when said control signal is in said first category or said second category, (4) actuating said electrode suspension control system to alter the arc gap to regulate the current to said metal when said control signal is in said second category, and (5) actuating said bypass means whereby said gases are diverted away from said treatment station when said control signal is in said third category.

2. The method as in claim 1, in which said first actuation level for the control signal is set below said second actuation level for the control signal by a differential of at least 25° F.

3. The method as in claim 1, in which in step (c) the arc gap is first increased and later decreased and said decrease of the arc gap takes place in response to a delay of at least 90 seconds after said control signal descends below the first actuation level.

4. The method as in claim 1, in which said arc gap is increased to provide a spacing between said electrodes and said metal of at least six inches thereby extinguishing the arc.

5. The method as in claim 1, in which a sensed temperature of 275° F. generates a control signal strength of said first actuation level and the sensed temperature of 300° F. generates a control signal strength of said second actuation level.

6. The method as in claim 1, in which said electrode suspension system is actuated and controlled by means effective to proportion the spacing between said electrodes and said metal in relation to the excess temperature of said gases over the sensed temperature that generates a control signal strength of said first actuation level.

7. The method as in claim 1, in which the control for actuating said electrode suspension control system in response to said control signal includes a closed loop computer programmed to cycle the actuation of said suspension system on a continuous basis and thereby achieve a relatively constant exhaust gas temperature.

8. A method for controlling exhaust gases from a direct arc electric furnace having (A) an electrode suspension control system effective to raise and lower furnace electrodes in relation to a metal charge within the furnace thereby to regulate the arc gap between said electrodes and said metal, (B) an exhaust conditioning system effective to collect gases generated by operation of said furnace and deliver said gases to a treatment station for removal of air pollutants from said gases, and (C) bypass means effective for diverting said gases away from said treatment station when the temperature of said gases exceeds a predetermined temperature, said method comprising:

(1) at a sensing location in said exhaust conditioning system positioned upstream from the entrance to said treating station, continuously sensing the temperature of said gases and generating a control signal having a strength proportional to the temperature sensed, (2) dividing said continuous control signal into three categories based on the strength of said continuous control signal, said three categories including (a) a first category comprising a first range of strength levels, (b) a second category comprising a second range of strength levels, (c) a third category comprising a third range of strength levels, (3) directing said gases in said exhaust conditioning system into said treatment station when said control signal is in said first category or said second category, (4) actuating said electrode suspension control system to alter the arc gap to regulate the current to said metal when said control signal is in said second category, and (5) actuating said bypass means whereby said gases are diverted away from said treatment station when said control signal is in said third category.

* * * * *